US009122186B2

(12) United States Patent
Tokoro

(10) Patent No.: US 9,122,186 B2
(45) Date of Patent: Sep. 1, 2015

(54) IMAGE FORMING APPARATUS WITH ENDLESS BELT AND METHOD FOR CALCULATING MEANDERING AMOUNT OF BELT

(71) Applicant: KYOCERA Document Solutions Inc., Osaka-shi, Osaka (JP)

(72) Inventor: Yoshitaka Tokoro, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/090,612

(22) Filed: Nov. 26, 2013

(65) Prior Publication Data

US 2014/0153942 A1 Jun. 5, 2014

(30) Foreign Application Priority Data

Nov. 30, 2012 (JP) ..... 2012-262351

(51) Int. Cl.
*G03G 15/00* (2006.01)
*G03G 15/01* (2006.01)
*G03G 15/16* (2006.01)

(52) U.S. Cl.
CPC ..... *G03G 15/0189* (2013.01); *G03G 15/1615* (2013.01)

(58) Field of Classification Search
None
See application file for complete search history.

(56) References Cited

U.S. PATENT DOCUMENTS 6,335,748 B1 * 1/2002 Furst ..... 347/116
6,909,516 B1 * 6/2005 Hoover ..... 356/615
2006/0289280 A1 12/2006 Furuya et al.
2008/0174791 A1 * 7/2008 Kudo ..... 358/1.5
2008/0285994 A1 * 11/2008 Tamura ..... 399/66
2009/0169274 A1 * 7/2009 Suzuki et al. ..... 399/302
2011/0293336 A1 * 12/2011 Noso et al. ..... 399/302

FOREIGN PATENT DOCUMENTS

JP H10-123794 * 5/1998 ..... G03G 15/01
JP 2000089529 3/2000
JP 2006-343629 12/2006
JP 2009086448 4/2009

OTHER PUBLICATIONS

Japanese Patent Application No. 2012-262351—Office Action issued on Nov. 18, 2014.

* cited by examiner

*Primary Examiner* — Clayton E Laballe
*Assistant Examiner* — Peter L Cheng
(74) *Attorney, Agent, or Firm* — Gerald E. Hespos; Michael J. Porco; Matthew T. Hespos

(57) ABSTRACT

An image forming apparatus includes a control unit which controls a correcting operation of correcting the meandering of an endless belt by a roller position adjusting mechanism. Prior to the correcting operation, the control unit causes a toner image for monitoring to be transferred to an area of a circumferential surface of the belt passing a detection area of a density sensor, causes the density sensor to perform a first detecting operation of detecting the toner image for monitoring, subsequently causes the density sensor to perform a second detecting operation of detecting the toner image for monitoring after the circumferential surface of the belt is moved by a predetermined distance, and calculates a meandering amount of the belt by comparing a first density value obtained by the first detecting operation and a second density value obtained by the second detecting operation.

8 Claims, 12 Drawing Sheets

T

| PULSE COUNT NUMBER | MEANDERING CORRECTION ROLLER TILT ANGLE | BELT MEANDERING AMOUNT |
|---|---|---|
| +1 | +A1 | +W1 |
| +2 | +A2 | +W2 |
| +3 | +A3 | +W3 |
| ⋮ | ⋮ | ⋮ |
| −1 | −A1 | −W1 |
| −2 | −A2 | −W2 |
| −3 | −A3 | −W3 |

IMAGE FORMING APPARATUS WITH ENDLESS BELT AND METHOD FOR CALCULATING MEANDERING AMOUNT OF BELT

This application is based on Japanese Patent Application Serial No. 2012-262351 filed with the Japan Patent Office on Nov. 30, 2012, the contents of which are hereby incorporated by reference.

BACKGROUND

The present disclosure relates to an image forming apparatus with an endless belt to which a toner image is to be transferred and particularly to a technique for controlling a meandering correction of the endless belt.

A color printer as an example of an image forming apparatus includes tandemly arranged image forming units of respective colors and an intermediate transfer belt (endless belt) to which toner images formed by these image forming units are to be primarily transferred. The intermediate transfer belt is driven and rotated and the toner images are successively transferred to a circumferential surface of the intermediate transfer belt in a superimposed manner in the image forming units of the respective colors, whereby a full color toner image is carried. This full color toner image is secondarily transferred to a sheet in a secondary transfer unit.

The intermediate transfer belt may move to meander or shift in a belt width direction perpendicular to a rotating direction while being driven and rotated. Such meandering or shifting causes transfer positions of toner images to the circumferential surface of the intermediate transfer belt to vary, thereby causing image defects such as color shift. Accordingly, a technique for correcting the meandering and shifting of a transfer belt is necessary.

There is known a meandering correction technique in which one of rollers on which an intermediate transfer belt is mounted is used as a meandering correction roller capable of adjusting an angle of inclination and the angle of inclination of the meandering correction roller is set according to a meandering amount of the belt. In this technique, the meandering amount of the intermediate transfer belt is grasped by monitoring a displacement of an edge position of this belt. For this monitoring, an optical or contact displacement sensor is arranged at an end part of the belt in a width direction.

SUMMARY

An image forming apparatus according to one aspect of the present disclosure includes an endless belt, an image forming unit, a plurality of rollers on which the belt is mounted, a roller position adjusting mechanism, a density sensor and a control unit.

The endless belt has a circumferential surface, to which a toner image is to be transferred, and is driven and rotated. The image forming unit is arranged to face the belt and forms a toner image and transfers the toner image to the belt. The plurality of rollers include a drive roller for driving and rotating the belt and a belt meandering correction roller for correcting meandering in a belt width direction perpendicular to a rotating direction of the belt. The roller position adjusting mechanism corrects the meandering of the belt by adjusting the position of the belt meandering correction roller. The density sensor has a detection area capable of detecting the density of the toner image and is fixedly arranged such that the detection area faces the circumferential surface of the belt.

The control unit controls a correcting operation of correcting the meandering of the belt by the roller position adjusting mechanism.

Prior to the correcting operation, the control unit controls the image forming unit while driving and rotating the belt, thereby transferring a toner image for monitoring at least to an area of the circumferential surface of the belt passing the detection area, causes the density sensor to perform a first detecting operation of detecting the toner image for monitoring, causes the density sensor to perform a second detecting operation of detecting the toner image for monitoring after the belt is driven and rotated to move the circumferential surface by a predetermined distance after the first detecting operation, and calculates a meandering amount of the belt by comparing a first density value obtained by the first detecting operation and a second density value obtained by the second detecting operation.

A method according to another aspect of the present disclosure is for calculating a meandering amount of an endless belt which has a circumferential surface, to which a toner image is to be transferred, and is driven and rotated and includes fixedly arranging a density sensor having a detection area capable of detecting the density of a toner image such that the detection area faces the circumferential surface of the belt, forming a toner image for monitoring in an area of the circumferential surface of the belt passing the detection area, detecting the toner image for monitoring by the density sensor as a first detecting operation, detecting the toner image for monitoring by the density sensor as a second detecting operation after the circumferential surface is moved by a predetermined distance by driving and rotating the belt after the first detecting operation, and calculating a meandering amount of the belt in a belt width direction perpendicular to a rotating direction of the belt by comparing a first density value obtained by the first detecting operation and a second density value obtained by the second detecting operation.

These and other objects, features and advantages of the present disclosure will become more apparent upon reading the following detailed description along with the accompanying drawings.

DETAILED DESCRIPTION

Figure 1:
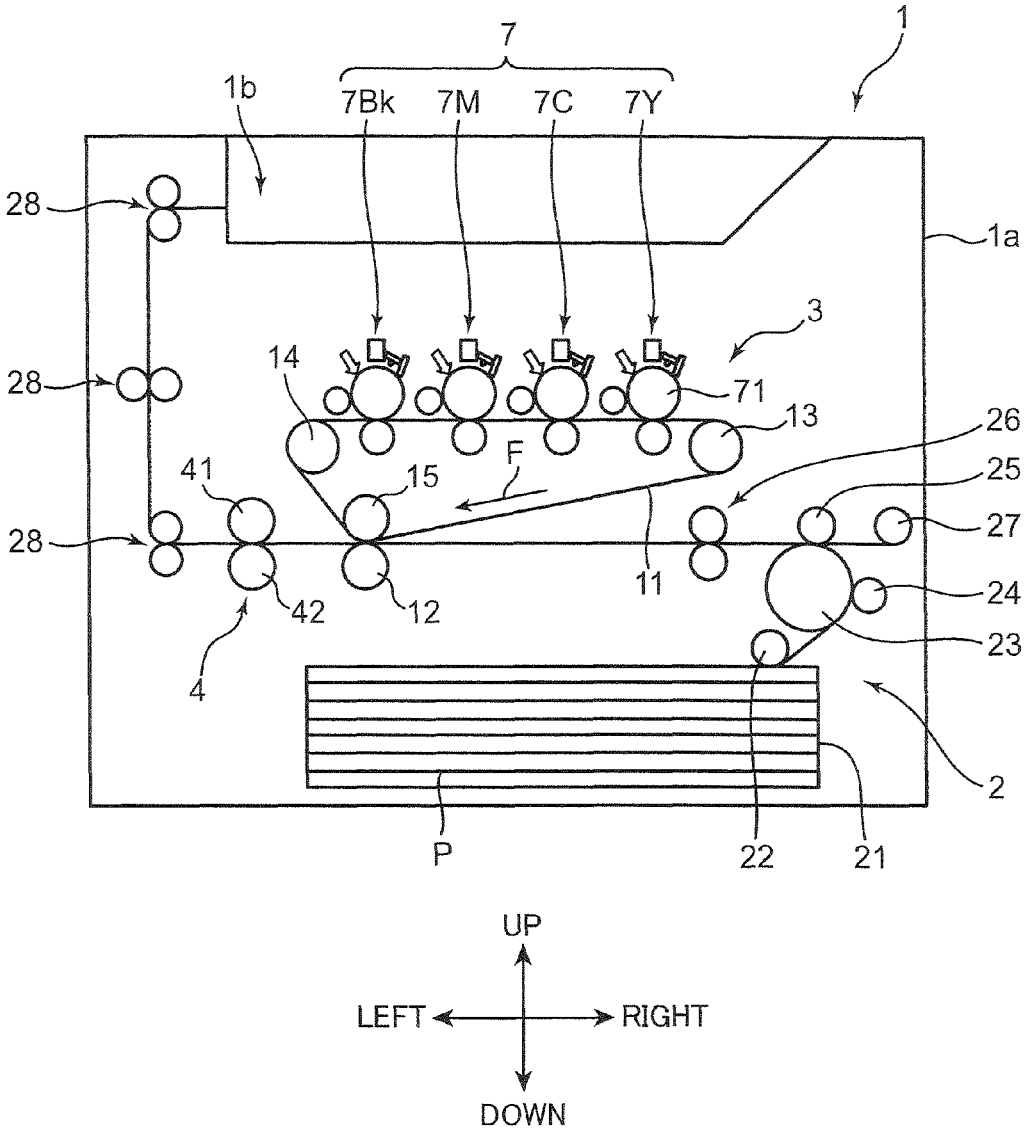
FIG. 1 is a schematic sectional view showing an overall internal structure of an image forming apparatus according to an embodiment of the present disclosure.
Figure 2:
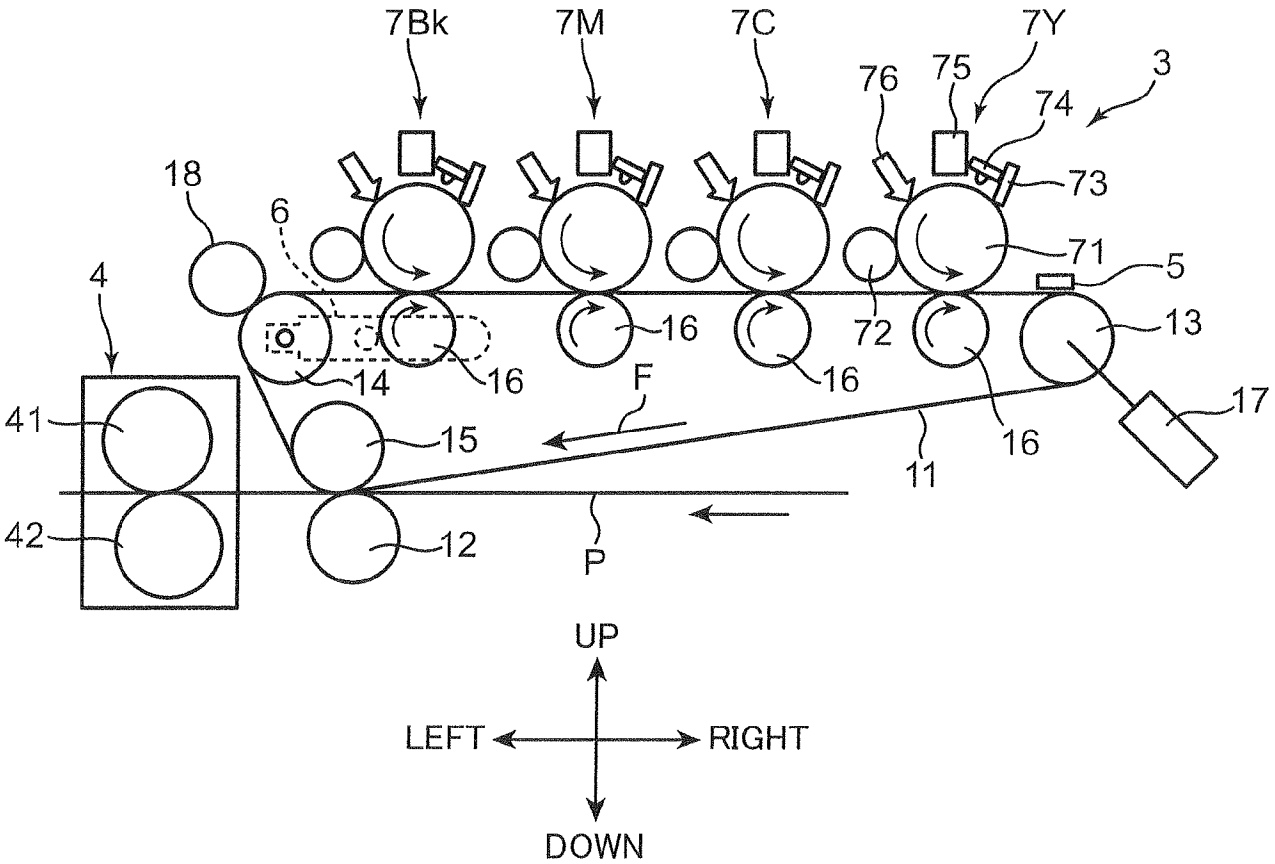
FIG. 2 is a sectional view showing an essential part of the image forming apparatus.

Hereinafter, an embodiment of the present disclosure is described in detail based on the drawings. FIG. 1 is a schematic sectional view showing an overall internal structure of an image forming apparatus 1 according to the embodiment of the present disclosure, and FIG. 2 is a sectional view showing an essential part of the image forming apparatus. Here, a tandem color printer is illustrated as an example of the image forming apparatus. The present disclosure is applicable to tandem image forming apparatuses in general using an intermediate transfer belt such as copiers, facsimile machines and complex machines of these without being limited to color printers.

The image forming apparatus 1 is provided with a box-shaped apparatus main body 1*a*. A sheet feeding unit 2 for feeding sheets P, an image forming station 3 for transferring an image to a sheet P fed from this sheet feeding unit 2 and being conveyed, and a fixing unit 4 for applying a fixing process to an image transferred to a sheet P are housed in the apparatus main body 1*a*. A sheet discharge unit 1*b* to which a sheet P subjected to the fixing process in the fixing unit 4 is discharged is provided on the upper surface of the apparatus main body 1*a*.

The sheet feeding unit 2 includes a sheet cassette 21 for storing sheets P of each size, a pickup roller 22 for picking up the sheets P stored in the sheet cassette 21 one by one, feed rollers 23, 24 and 25 for feeding the sheet P picked up by the pickup roller 22 to a sheet conveyance path, and registration rollers 26. Further, the sheet feeding unit 2 includes a manual feed tray (not shown) attached to the right side surface of the apparatus main body 1*a* and a pickup roller 27 for picking up a sheet placed on this manual feed tray. The registration rollers 26 feed the sheet P fed to the sheet conveyance path by the pickup rollers 22 or 27 and the feed rollers 23, 24 and 25 to the image forming station 3 at a predetermined timing after causing the sheet P to temporarily wait. The sheet cassette 21 is detachably insertable into the apparatus main body 1*a* and pulled out from the apparatus main body 1*a* when the sheets run out.

The image forming station 3 includes an image forming unit 7 (image forming unit) for forming toner images, an intermediate transfer belt 11 (endless belt) having a circumferential surface (contact surface) to which toner images are primarily transferred from the image forming unit 7 and driven and rotated in a rotating direction F shown by an arrow in FIG. 1, and a secondary transfer roller 12 for secondarily transferring the toner images on this intermediate transfer belt 11 to a sheet P fed from the sheet feeding unit 2.

The image forming unit 7 includes a black unit 7Bk, a magenta unit 7M, a cyan unit 7C and a yellow unit 7Y successively arranged from an upstream side (left side in FIGS. 1 and 2) toward a downstream side in the rotating direction F of the intermediate transfer belt 11. Each of the units 7Bk, 7M, 7C and 7Y includes a photoconductive drum 71 for carrying a toner image of a corresponding color. Each photoconductive drum 71 is rotatable in an arrow direction (counterclockwise direction) about a drum shaft. A charger 75, an exposure device 76, a developing device 72, a cleaning device 73 and a charge remover 74 are successively arranged around each photoconductive drum 71 from an upstream side in a rotating direction.

The charger 75 is for uniformly charging a circumferential surface of the photoconductive drum 71 and, for example, a scorotron charger can be used as such. The exposure device 76 is a unit with a laser light source and a scanning optical system. The exposure device 76 forms an electrostatic latent image on the photoconductive drum 71 by irradiating the circumferential surface of the photoconductive drum 71 uniformly charged by the charger 75 with laser light modulated based on image data input from an external computer or the like. The developing device 72 supplies toner to the circumferential surface of the photoconductive drum 71 on which an electrostatic latent image is formed, thereby developing the electrostatic latent image and forming a toner image. This toner image is primarily transferred to the intermediate transfer belt 11. The cleaning device 73 cleans the toner remaining on the circumferential surface of the photoconductive drum 71 after the primary transfer of the toner image to the intermediate transfer belt 11 is finished. The charge remover 74 removes electric charges on the circumferential surface of the photoconductive drum 71 after the primary transfer is finished.

The intermediate transfer belt 11 is an endless belt and mounted on a plurality of rollers including a drive roller 13, a driven roller 14 (belt meandering correction roller), a backup roller 15 and primary transfer rollers 16 such that the outer circumferential surface (circumferential surface to which toner images are transferred) is held in contact with the circumferential surface of each photoconductive drum 71. The primary transfer roller 16 is arranged to face the corresponding photoconductive drum 71 with the intermediate transfer belt 11 sandwiched therebetween, thereby forming a primary transfer nip portion. Further, the backup roller 15 is arranged to face the secondary transfer roller 12 with the intermediate transfer belt 11 sandwiched therebetween, thereby forming a secondary transfer nip portion. The intermediate transfer belt 11 endlessly rotates with the inner and outer circumferential surfaces held in contact with these plurality of rollers.

The drive roller 13 is a roller for applying a drive force to drive and rotate the intermediate transfer belt 11 in the rotating direction F. The drive roller 13 is a roller including an elastic layer made of urethane rubber or the like on a surface, and driven and rotated about a shaft by a belt drive motor 17. For example, a stepping motor can be used as the belt drive motor 17.

The driven roller 14 is a roller which rotates, following the rotational drive of the intermediate transfer belt 11. The drive roller 13 is arranged at the right end of a rotation path of the intermediate transfer belt 11, whereas the driven roller 14 is arranged at the left end of the rotation path right opposite to the drive roller 13. A roller position adjusting mechanism 6 for correcting the meandering of the intermediate transfer belt 11 by adjusting a rotary shaft of this driven roller 14 (adjusting the position of the belt meandering correction roller) is attached in this embodiment. This roller position adjusting mechanism 6 is described in detail later.

The backup roller 15 and the primary transfer rollers 16 are also rollers which rotate, following the rotational drive of the intermediate transfer belt 11. A primary transfer bias (having a polarity opposite to a charging polarity of the toner) is applied to the primary transfer roller 16, whereby the toner image formed on each photoconductive drum 71 is transferred to the intermediate transfer belt 11 in the primary transfer nip portion. Note that primary transfer timings of the toner images of the respective colors are controlled so that the toner images of the respective units 7Bk, 7M, 7C and 7Y are successively transferred onto the same position of the intermediate transfer belt 11, whereby a full color toner image is transferred to the intermediate transfer belt 11.

The secondary transfer roller 12 is arranged to face the backup roller 15. A secondary transfer bias having a polarity opposite to the charging polarity of the toner is applied to the secondary transfer roller 12 at a timing at which a sheet P passes through the secondary transfer nip portion. The toner images carried on the circumferential surface of the intermediate transfer belt 11 are secondarily transferred to the sheet P by the application of this secondary transfer bias.

A belt cleaner 18 is arranged at a position facing the driven roller 14 (position downstream of a secondary transfer unit). The belt cleaner 18 includes a brush roller or the like arranged in contact with the circumferential surface of the intermediate transfer belt 11 and removes the toner remaining on the circumferential surface of the intermediate transfer belt 11 after the secondary transfer. Further, a patch toner image formed at the time of density calibration of toner images to be carried on the intermediate transfer belt 11 is also removed by this belt cleaner 18.

Density sensors 5 are arranged to face the circumferential surface of the intermediate transfer belt 11 near the drive roller 13. The density sensor 5 has a detection area capable of detecting the density of a toner image and is fixedly arranged such that the detection area faces the circumferential surface of the intermediate transfer belt 11. For example, an optical density sensor including a light emitter for emitting inspection light to the belt circumferential surface and a light receiver for detecting reflected light (polarized component) from the belt circumferential surface can be used as the density sensor 5. The density sensor 5 detects the density of a patch toner image at the time of the aforementioned density calibration of toner images. In addition, as described later, the density sensor 5 also detects the density of a patch toner image (toner image for monitoring) formed on the circumferential surface of the intermediate transfer belt 11 to detect a meandering amount of the intermediate transfer belt 11 in this embodiment.

The fixing unit 4 applies a fixing process of fixing a toner image transferred to a sheet P in the image forming station 3 to the sheet P. The fixing unit 4 includes a heating roller 41 heated by a conductive heating element and a pressure roller 42 arranged to face this heating roller 41 and having a circumferential surface pressed into contact with the circumferential surface of the heating roller 41. A toner image transferred to a sheet P is fixed to the sheet P in the fixing process by heating when this sheet P passes between the heating roller 41 and the pressure roller 42.

Conveyor rollers 28 for conveying a sheet are arranged at appropriate positions in a sheet conveyance path downstream of the fixing unit 4. The sheet P subjected to the fixing process is conveyed by the conveyor rollers 28 and discharged to the sheet discharge unit 1*b* on the upper surface of the apparatus main body 1*a*.

Next, the operation of the image forming apparatus 1 having the above configuration is briefly described. When image data to be printed and a print command are input to the image forming apparatus 1 from an external apparatus such as a personal computer, the image forming station 3 starts image formation. Specifically, the photoconductive drum 71 is driven and rotated and the circumferential surface thereof is substantially uniformly charged by the charger 75. Subsequently, laser light modulated based on the image data is irradiated to the circumferential surface from the exposure device 76 to form an electrostatic latent image. This electrostatic latent image is developed into a toner image by the supply of the toner to the circumferential surface of the photoconductive drum 71 from the developing device 72. This operation is performed for each of the units 7Bk, 7M, 7C and 7Y. The rotational drive of the intermediate transfer belt 11 is also started as the photoconductive drums 71 are driven and rotated, whereby the toner images of the respective colors are transferred onto the same position of the circumferential surface of the intermediate transfer belt 11 in a superimposed manner. In this way, a full color toner image is carried on the intermediate transfer belt 11.

Collaterally, a sheet P is picked up and fed to the sheet conveyance path by the pickup roller 22 and the feed rollers 23, 24 and 25. Thereafter, the sheet P is temporarily stopped by the registration rollers 26 and fed to the secondary transfer nip portion in synchronization with a timing at which the full color toner image carried on the intermediate transfer belt 11 arrives at the secondary transfer roller 12 (secondary transfer nip portion). The full color toner image is transferred to this sheet P when the sheet P passes through the secondary transfer nip portion. Thereafter, the sheet P is conveyed to the fixing unit 4 to fix the toner image to the sheet P. Thereafter, the sheet P is discharged to the sheet discharge unit 1*b* by the conveyor rollers 28.

The above is a schematic operation of the image forming apparatus 1 in the case of forming an image on a sheet P. On the other hand, the image forming apparatus 1 performs a calibration operation (toner image density calibration operation) during an image non-forming period in which the image forming operation is not performed. The image non-forming period is a paper interval or a job interval in the case of performing the image forming operation on a plurality of sheets P, a timing at which the image forming apparatus 1 is powered on or off or the like. In the density calibration operation, a patch toner image is transferred to the intermediate transfer belt 11 using one or more of the units 7Bk, 7M, 7C and 7Y and the density of the patch toner image is detected by the density sensors 5. Toner density is stabilized by adjusting parameters such as developing biases according to the detected density.

Further in this embodiment, a meandering correcting operation of the intermediate transfer belt 11 is performed at an appropriate timing during the image non-forming period. The meandering correcting operation includes a step of detecting a meandering amount of the intermediate transfer belt 11 and a step of adjusting the position of the driven roller 14 according to the meandering amount. In the detecting step, instead of using a special sensor for detecting the meandering amount, the image forming station 3 is caused to transfer a special patch toner image for detecting the meandering amount to the circumferential surface of the intermediate transfer belt 11 and the patch toner image is detected using the density sensors 5 disposed for the density calibration operation to calculate the meandering amount. In the position adjusting step, the roller position adjusting mechanism 6 adjusts the angle of inclination of the rotary shaft of the driven roller 14 according to the meandering amount. A configuration provided in the image forming apparatus 1 for this meandering correcting operation and the operation thereof are described in detail below.

Figure 3:
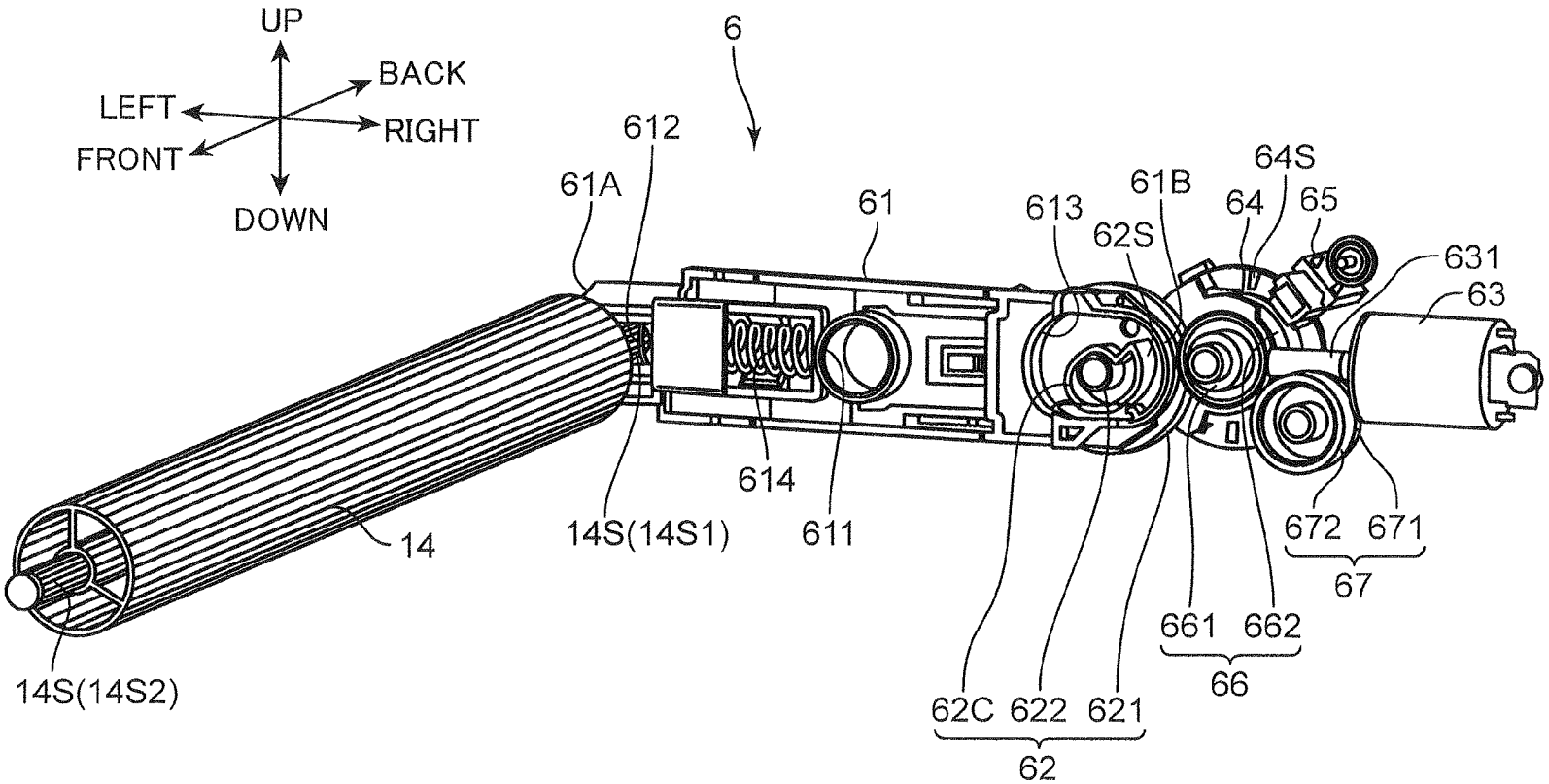
FIG. 3 is a perspective view showing a roller position adjusting mechanism according to the embodiment.

FIG. 3 is a perspective view showing the roller position adjusting mechanism 6 according to this embodiment. The roller position adjusting mechanism 6 corrects the meandering and shifting of the intermediate transfer belt 11 by adjusting the inclination of the rotary shaft of the driven roller 14 on which the intermediate transfer belt 11 is mounted. The roller position adjusting mechanism 6 includes an arm 61, a cam member 62, a cam motor 63, a pulse plate 64, a pulse plate sensor 65, a transmission gear 66 and an idle gear 67.

The arm 61 is roughly a rectangular plate-like member including one end (left end 61A) and another end (right end 61B) and long in one direction (lateral direction). The arm 61 includes a supporting hole 611 provided in a lateral central part, a shaft supporting hole 612 provided near the left end 61A and a cam hole 613 provided near the right end 61B.

The supporting hole 611 is a hole into which an unillustrated supporting shaft projecting from a frame of the apparatus main body 1*a* is tightly fitted. The arm 61 pivots about an axis of this supporting hole 611. The shaft supporting hole 612 is a long hole which is long in the lateral direction and into which one end (rear end 14S1) of a rotary shaft 14S of the driven roller 14 is inserted. Note that another end (front end 14S2) of the rotary shaft 14S is fixedly supported by an unillustrated shaft supporting portion provided on the frame. The cam hole 613 is a substantially elliptical hole whose minor axis extends in a vertical direction and whose major axis extends in the lateral direction. A wall surface defining the cam hole 613 serves as a contact surface for a cam. A coil spring 614 is so arranged in the arm 61 that one end thereof is inserted in the shaft supporting hole 612. The coil spring 614 biases the rotary shaft 14S leftward, thereby applying tension to the intermediate transfer belt 11.

The cam member 62 is a member for pivoting the arm 61 about the axis of the supporting hole 611 and includes a cam portion 62C, a gear plate portion 621 and a bearing portion 622. The cam portion 62C has a curved surface (see FIG. 3, schematically shown in FIG. 4) approximate to a clothoid curve in an end view, i.e. has a shape whose cam diameter gradually changes, and the outer circumferential surface thereof serves as a cam surface 62S. The gear plate portion 621 is a disk-like member and includes gear teeth on the outer peripheral edge thereof. The bearing portion 622 is a cylindrical member projecting forward from a center of the gear plate portion 621. The cam member 62 rotates about an axis of this bearing portion 622. The cam portion 62C projects forward from the gear plate portion 621 to surround the bearing portion 622.

The cam member 62 is assembled with the arm 61 so that the cam portion 62C is inserted into the cam hole 613 of the arm 61. A part of the arm 61 including the right end 61B is biased upward by an unillustrated biasing member so that the wall surface of the cam hole 613 is constantly in contact with the cam surface 62S of the cam portion 62C.

Figure 4:
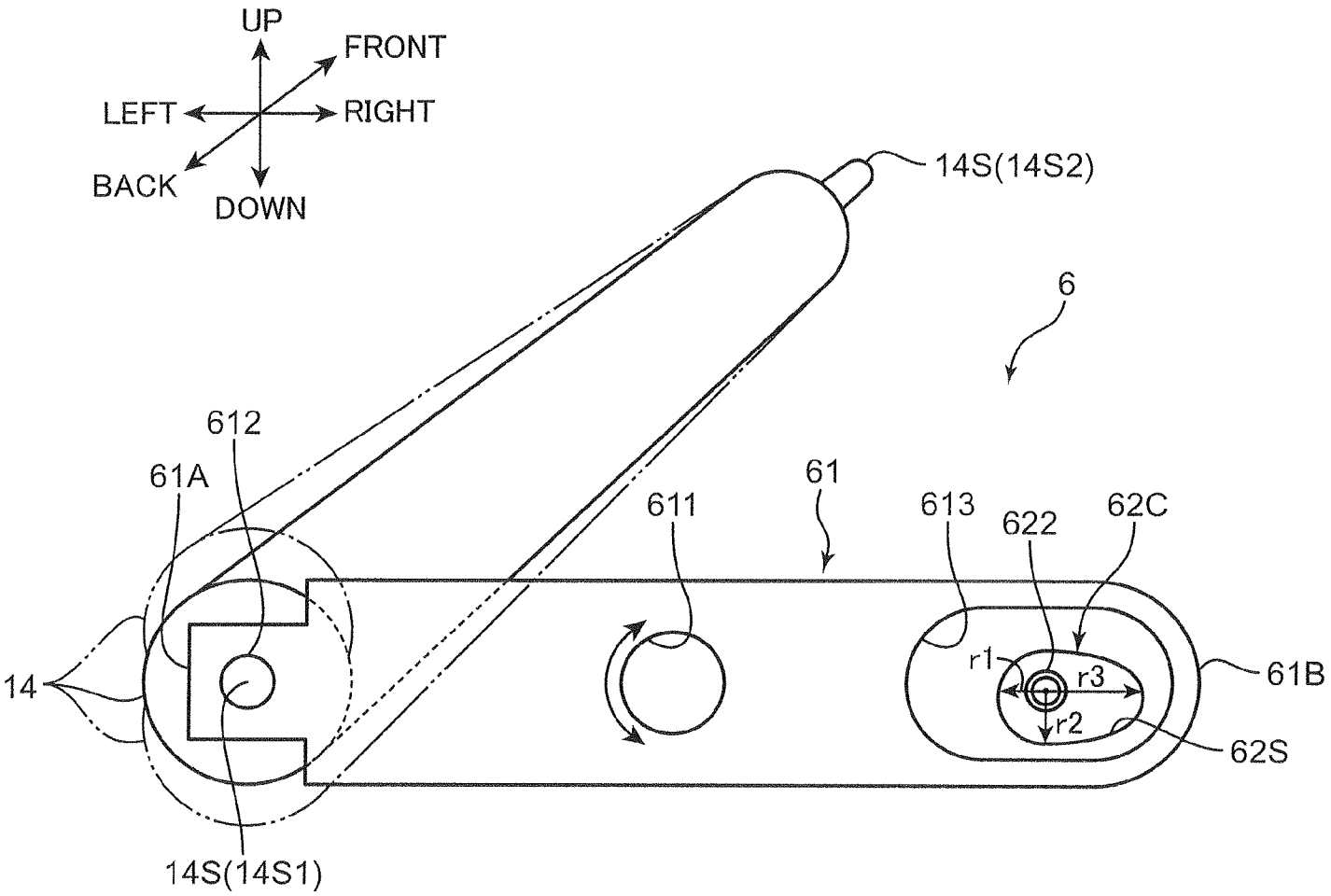
FIG. 4 is a diagram showing an operation of inclining a driven roller (belt meandering correction roller) by the roller position adjusting mechanism.

FIG. 4 is a diagram showing an operation of inclining the driven roller 14 by the roller position adjusting mechanism 6. In FIG. 4, front and rear sides of FIG. 3 are reversed and the arm 61 and the cam portion 62C are shown in a simplified manner. The cam portion 62C roughly includes a small diameter portion r1, a middle diameter portion r2 and a large diameter portion r3 when viewed from a center of rotation of the cam member 62. In FIG. 4 (FIG. 3), the cam surface 62S and the wall surface of the cam hole 613 are shown to be in contact in the medium diameter portion r2 of the cam portion 62C. Here, the rotary shaft 14S of the driven roller 14 is assumed to be horizontal in this state.

If the cam portion 62C rotates counterclockwise in the horizontal state, the cam surface 62S and the wall surface of the cam hole 613 come into contact in the small diameter portion r1. In this case, the arm 61 pivots counterclockwise about the axis of the supporting hole 611. Associated with this, the left end 61A of the arm 61 moves downward and the rear end 14S1 of the rotary shaft 14S of the driven roller 14 also moves downward. Since the front end 14S2 of the rotary shaft 14S is supported by the unpivotable shaft supporting portion, the rotary shaft 14S reaches an inclined state, where the rear end 14S1 is lowered, from the horizontal state. On the other hand, if the cam portion 62C rotates clockwise in the horizontal state, the cam surface 62S and the wall surface of the cam hole 613 come into contact in the large diameter portion r3. In this case, the arm 61 pivots clockwise about the axis of the supporting hole 611. Associated with this, the left end 61A of the arm 61 moves upward and the rear end 14S1 of the rotary shaft 14S of the driven roller 14 also moves upward. Thus, the rotary shaft 14S reaches an inclined state, where the rear end 14S1 is raised, from the horizontal state.

By rotating the cam portion 62C in this way, the inclination of the rotary shaft 14S of the driven roller 14 can be adjusted. Particularly since the cam portion 62C is shaped such that the cam diameter gradually changes from the small diameter portion r1 to the large diameter portion r3, the inclination of the rotary shaft 14S can be finely adjusted by controlling an angle of rotation of the cam portion 62C. Note that the intermediate transfer belt 11 moves backward if the rear end 14S1 of the rotary shaft 14S is moved downward while moving backward if the rear end 14S1 of the rotary shaft 14S is moved upward.

The cam motor 63 is a cam drive source which includes an output rotary shaft 631 and generates a drive force for rotating the cam portion 62C. For example, a stepping motor or DC motor can be used as the cam motor 63. The pulse plate 64 and the pulse plate sensor 65 constitute an optical rotary encoder arranged to detect a pivot position of the arm 61. The pulse plate 64 is a disk member and includes a plurality of slits 64S arranged at equal intervals in a circumferential direction near the outer peripheral edge thereof (see FIG. 5A). The pulse plate sensor 65 is an optical sensor including a light emitting element and a light receiving element and arranged such that the pulse plate 64 is sandwiched in a sensor space between the light emitting element and the light receiving element. The light receiving element receives inspection light emitted from the light emitting element when the pulse plate 64 rotates about a disk central axis and the slits 64S pass through the sensor space, and does not receive the inspection light when areas other than the slits 64S pass. Thus, the pulse plate sensor 65 outputs a light receiving signal (pulse) at each arrangement pitch of the slit 64S.

The transmission gear 66 and the idle gear 67 are gears arranged to transmit a drive force of the cam motor 63 to the cam member 62. The transmission gear 66 is a gear including a small diameter gear portion 661 and a large diameter gear portion 662 adjacent in an axial direction and is supported on the same shaft (not shown) as the pulse plate 64. Accordingly, the transmission gear 66 and the pulse plate 64 rotate in synchronization. The idle gear 67 is also a gear including a small diameter gear portion 671 and a large diameter gear portion 672 adjacent in the axial direction.

The large diameter gear portion 672 of the idle gear 67 is engaged with the output rotary shaft 631 of the cam motor 63 and the small diameter gear portion 671 is engaged with the large diameter gear portion 662 of the transmission gear 66. On the other hand, the small diameter gear portion 661 of the transmission gear 66 is engaged with the gear teeth of the gear plate portion 621 of the cam member 62. Accordingly, when the output rotary shaft 631 of the cam motor 63 generates a forward or reverse rotational drive force, that rotational drive force is transmitted to the cam member 62 via the idle gear 67 and the transmission gear 66 to rotate the cam portion 62C in a forward or reverse direction. At this time, the pulse plate 64 also rotates in synchronization with the rotation of the transmission gear 66.

Figures 5A, 5B:
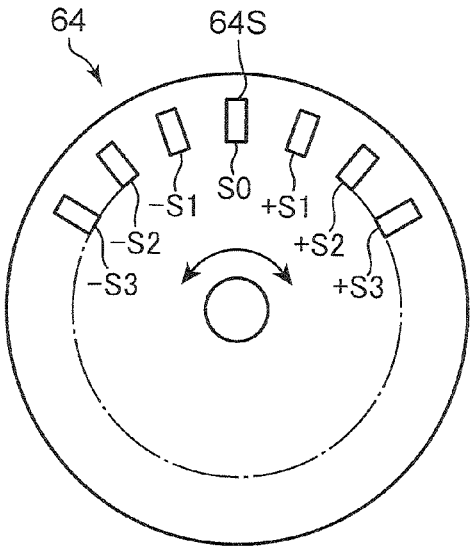
FIG. 5A is a front view of a pulse plate and FIG. 5B is a table showing an example of a meandering correction table.

FIG. 5A is a front view of the pulse plate 64 and FIG. 5B is a table showing an example of a meandering correction table T. The meandering correction table T is a table prepared in advance by relating a rotation amount of the pulse plate 64 and a degree of pivot of the arm 61, i.e. the inclination (tilt angle) of the rotary shaft 14S of the driven roller 14. "Pulse count number" in the left column of the meandering correction table T represents the rotation amount of the pulse plate 64 corresponding to the pitch of the slits 64S of the pulse plate 64.

As shown in FIG. 5A, a reference slit S0 is selected from the plurality of slits 64S and a state where this reference slit S0 is located in the sensor space of the pulse plate sensor 65 is a home position of the pulse plate 64. When the pulse plate 64 is rotated counterclockwise and the next slit +S1 reaches the sensor space, the pulse plate sensor 65 outputs a light receiving pulse, wherefore the pulse count number=+1. When the pulse plate 64 is further rotated counterclockwise, the pulse count number increases to +2, +3 as the slits +S2, +S3 pass. Similarly, when the pulse plate 64 is rotated clockwise, the pulse count number successively increases to −1, −2, −3 as the slits −S1, −S2, −S3 pass through the sensor space.

Tilt angles (+A1, +A2, +A3, . . . , −A1, −A2, −A3, . . . ) of the rotary shaft 14S of the driven roller 14 as the meandering correction roller are respectively related to such pulse count numbers. That is, it is known in advance how much the rotary shaft 14S can be inclined by rotating the pulse plate 64 in the forward or reverse direction by how many slit pitches. Further, meandering amounts (+W1, +W2, +W3, . . . , −W1, −W2, −W3, . . . ) of the intermediate transfer belt 11 are respectively related to the tilt angles of the driven roller 14. Thus, if the belt meandering amount is calculated by a method to be described later based on the detecting operation of the density sensors 5, the meandering of the intermediate transfer belt 11 can be corrected by driving the cam motor 63 to rotate the pulse plate 64 by the pulse count number corresponding to the calculated belt meandering amount.

Figure 6:
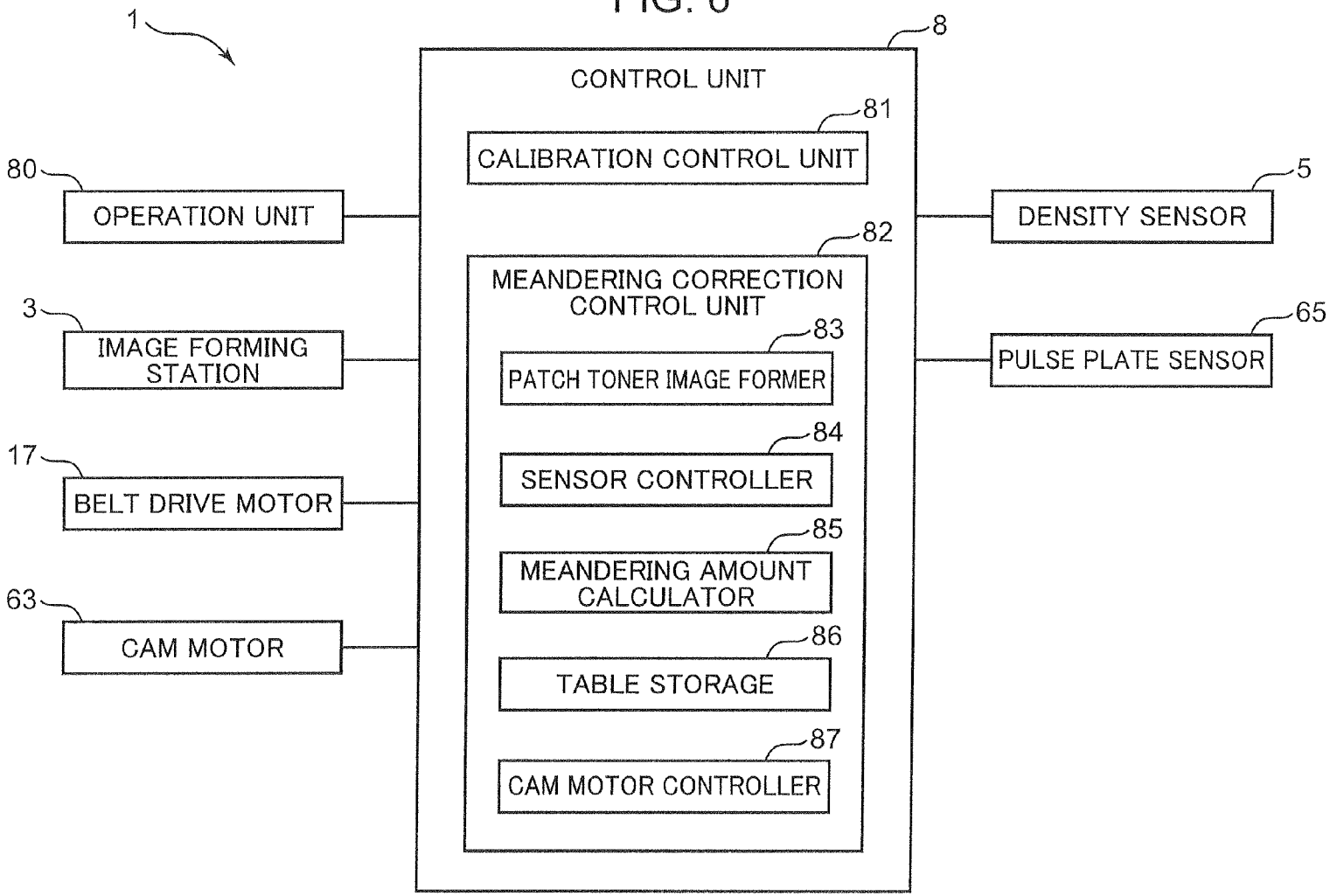
FIG. 6 is a block diagram showing an electrical configuration of the image forming apparatus.

Next, an electrical configuration of the image forming apparatus 1 is described based on a block diagram of FIG. 6. In addition to the aforementioned configuration, the image forming apparatus 1 includes a control unit 8 and an operation unit 80. The control unit 8 is composed of a CPU (Central Processing Unit), a ROM (Read Only Memory) storing a control program, a RAM (Random Access Memory) used as a work area of the CPU and the like, and controls the operation of the entire image forming apparatus 1. The meandering correcting operation of the intermediate transfer belt 11 using the aforementioned roller position adjusting mechanism 6 is also controlled by this control unit 8. The operation unit 80 is composed of a liquid crystal touch panel, operation buttons and the like and receives the input of various set values and the input of operation information.

The control unit 8 includes a calibration control unit 81 and a meandering correction control unit 82 in addition to functional units for controlling a normal image forming operation. The calibration control unit 81 controls the aforementioned toner image density calibration operation. The calibration control unit 81 operates the image forming station 3 to transfer a patch toner image to the intermediate transfer belt 11 and causes the density sensor 5 to detect the density of this patch toner image at an appropriate timing during the image non-forming period. Further, the calibration control unit 81 adjusts parameters such as developing biases according to the detected density.

The meandering correction control unit 82 controls the meandering correcting operation of the intermediate transfer belt 11. For this control, the meandering correction control unit 82 causes the image forming station 3 to transfer a special patch toner image for meandering amount detection to the circumferential surface of the intermediate transfer belt 11 and causes the density sensors 5 to detect the density of this patch toner image. Further, the meandering correction control unit 82 calculates the belt meandering amount based on a result of the above detection and sets the tilt angle of the rotary shaft 14S of the driven roller 14 at a proper value using the cam motor 63 and the pulse plate sensor 65. In this embodiment, the meandering correction control unit 82 functionally includes a patch toner image former 83, a sensor controller 84, a meandering amount calculator 85, a table storage 86 and a cam motor controller 87.

The patch toner image former 83 causes a patch toner image for meandering amount detection (toner image for monitoring) to be transferred to the circumferential surface of the intermediate transfer belt 11 by controlling the image forming station 3 while driving the belt drive motor 17 to drive and rotate the intermediate transfer belt 11 at an appropriate timing during the image non-forming period set as a timing for performing a meandering correction.

Figure 7:
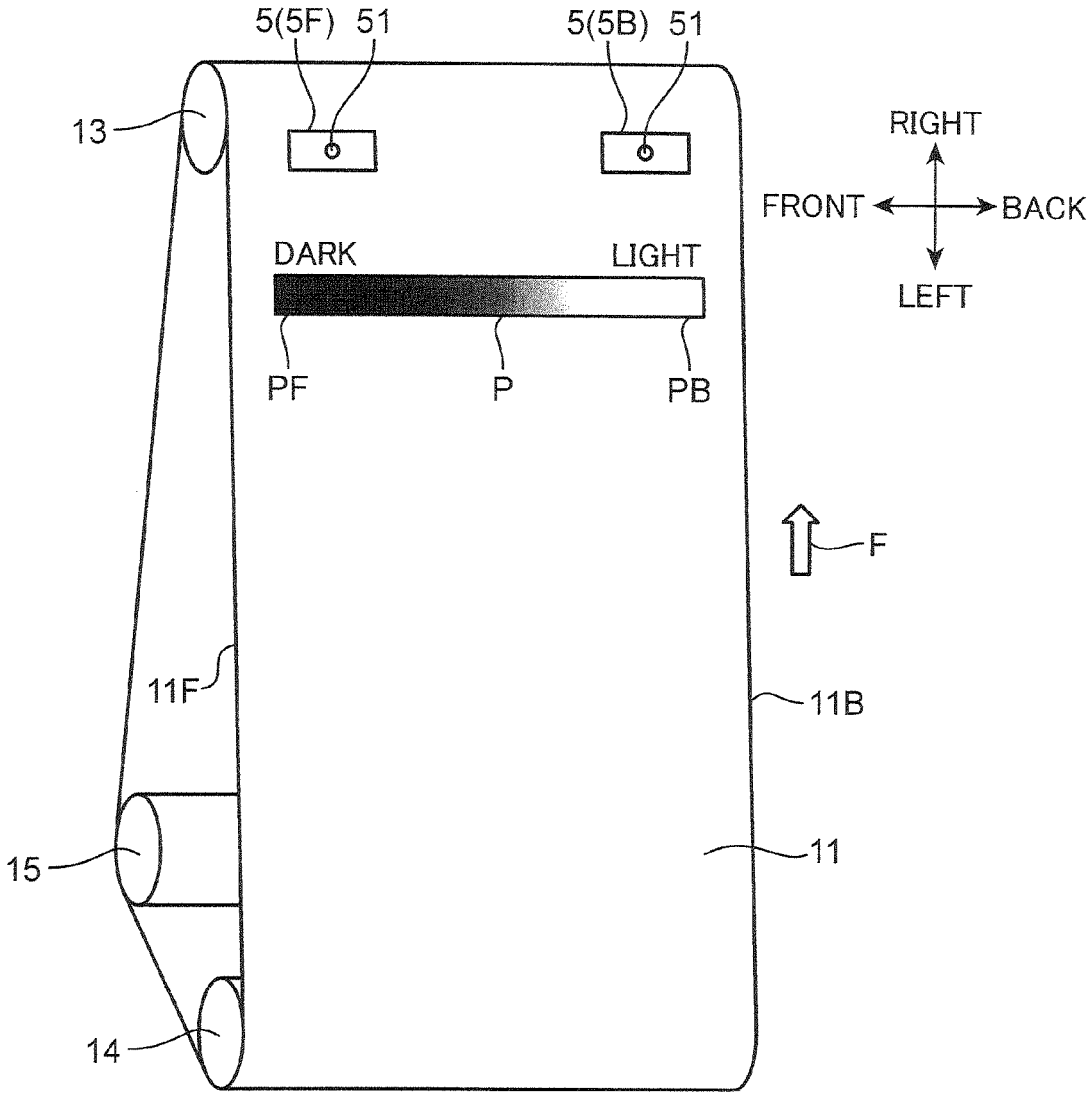
FIG. 7 is a view showing an example of a toner image for monitoring formed on a circumferential surface of an endless belt.

FIG. 7 is a view showing an example of a patch toner image P formed on the circumferential surface of the intermediate transfer belt 11 by the patch toner image former 83. The patch toner image P illustrated here is a strip-like toner image long in the belt width direction (front-back direction/main scanning direction of the photoconductive drums 71) perpendicular to the rotating direction F of the intermediate transfer belt 11. In addition, the patch toner image P has a density variation in the belt width direction. Specifically, the patch toner image P has a density pattern in which density gradually changes so that the density of a front end part PF located on the side of the front end 11F of the intermediate transfer belt 11 is highest and that of a rear end part PB located on the side of the rear end 11B is lowest.

Two density sensors 5 are used here. Specifically, a first density sensor 5F arranged near the front end 11F of the intermediate transfer belt 11 and a second density sensor 5B arranged near the rear end 11B are arranged to face the circumferential surface of the intermediate transfer belt 11 near the drive roller 13. Each of the first and second density sensors 5F, 5B has a detection area 51 capable of detecting toner density and is fixedly supported on the unillustrated frame of the apparatus main body 1*a* in a state where this detection area 51 is facing the circumferential surface of the intermediate transfer belt 11. The detection area 51 is an area to which the inspection light is projected in the case of using the aforementioned optical density sensor as the density sensor 5.

The sensor controller 84 causes the first and second density sensors 5F, 5B to perform a detecting operation of detecting the density of the patch toner image P prior to the meandering correction of the intermediate transfer belt 11. This detecting operation is actually an operation of applying power to drivers of the first and second density sensors 5F, 5B, causing light emitters to emit inspection light and obtaining light receiving signals of the reflected light from light receivers. The sensor controller 84 performs the first density detection of the patch toner image P when the patch toner image P on the intermediate transfer belt 11 passes an arrangement position of the first and second density sensors 5F, 5B (first detecting operation). Then, after the patch toner image P on the intermediate transfer belt 11 moves by a predetermined distance by the rotational drive of the intermediate transfer belt 11, the sensor controller 84 causes the first and second density sensors 5F, 5B to perform the second density detection of the patch toner image P (second detecting operation).

The meander amount calculator 85 calculates the meandering amount of the intermediate transfer belt 11 by comparing a first density value obtained by the first detecting operation and a second density value obtained by the second detecting operation. If the intermediate transfer belt 11 does not meander, the first and second density values are equal in the first and second density sensors 5F, 5B, respectively. However, if the intermediate transfer belt 11 meanders, a positional relationship between the first and second density sensors 5F, 5B and the patch toner image having the density variation in the belt width direction changes, wherefore the first and second density values are not equal and a density difference is detected. The meander amount calculator 85 calculates the meandering amount of the intermediate transfer belt 11 from this density difference and a movement amount of the intermediate transfer belt 11 between the first and second detecting operations.

Figure 8:
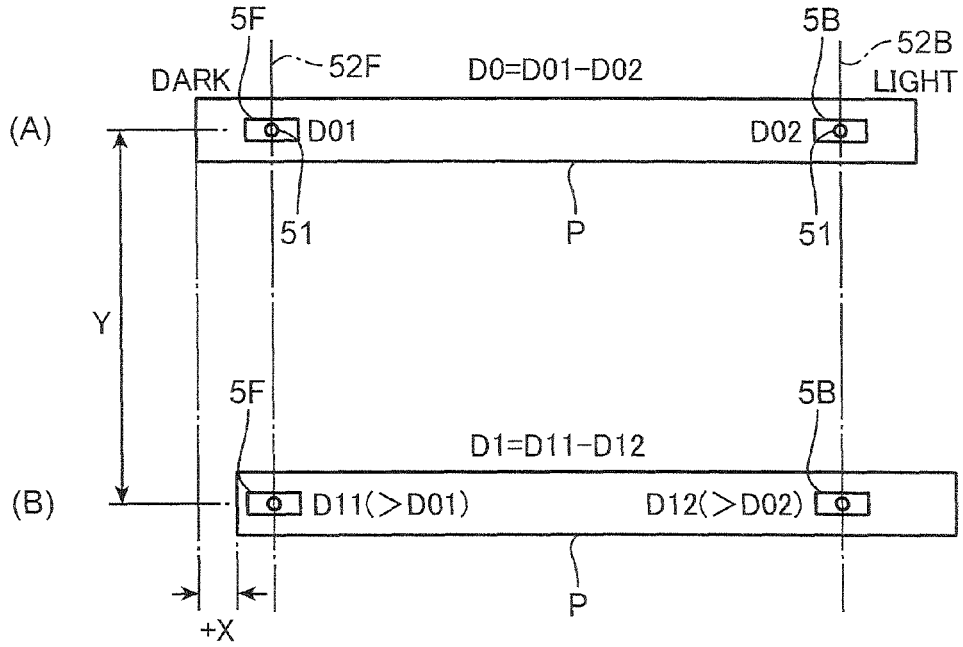
FIG. 8 is a view showing a belt meandering detecting operation.

FIG. 8 is a view diagrammatically showing the above first and second detecting operations. A section (A) of FIG. 8 shows a positional relationship between the patch toner image P and the first and second density sensors 5F, 5B in a state where the first and second density sensors 5F, 5B are performing the first detecting operation. A section (B) of FIG. 8 shows a positional relationship between the patch toner image P and the first and second density sensors 5F, 5B in a state where the first and second density sensors 5F, 5B are performing the second detecting operation. Detection lines 52F, 52B shown in dashed-dotted line indicate detection lines by the respective detection areas 51 of the first and second density sensors 5F, 5B. Since the first and second density sensors 5F, 5B are fixedly arranged, the detection lines 52F, 52B do not meander.

On the other hand, if the intermediate transfer belt 11 meanders, the position of the patch toner image P swings in the belt width direction. FIG. 8 shows an example in which the patch toner image P is shifted backward by +X when the intermediate transfer belt 11 moves by a distance Y between the first and second detecting operations. In this case, in the first detecting operation in the section (A) of FIG. 8, the first density sensor 5F detects the density of a part of the patch toner image P facing the detection area 51 as a first density value D01. In the subsequent second detecting operation in the section (B) of FIG. 8, the first density sensor 5F similarly detects the density of a part of the patch toner image P facing the detection area 51 as a second density value D11. In this case, the second density value D11 is a value indicating higher density than the first density value D01. This is due to the detection of a higher density area of the patch toner image P by the first density sensor 5F associated with the backward shift of the patch toner image P by +X.

The same also applies to the second density sensor 5B. In the first detecting operation in the section (A) of FIG. 8, the second density sensor 5B detects the density of a part of the patch toner image P facing the detection area 51 as a first density value D02. In the subsequent second detecting operation in the section (B) of FIG. 8, the second density sensor 5B similarly detects the density of a part of the patch toner image P facing the detection area 51 as a second density value D12. In this case, the second density value D12 is a value indicating higher density than the first density value D02.

A density gradient in the belt width direction of the patch toner image P can be easily normalized such as from an exposure pattern by the exposure device 76. Accordingly, the shift amount +X can be calculated by comparing the first and second density values D01, D11 obtained by the first density sensor 5F or the first and second density values D02, D12 obtained by the second density sensor 5B. On the other hand, the moving distance Y of the intermediate transfer belt 11 can be calculated by multiplying a rotational driving speed and a driving time of the intermediate transfer belt 11. The meandering amount of the intermediate transfer belt 11 can be calculated from the obtained shift amount +X and moving distance Y.

Figure 9:
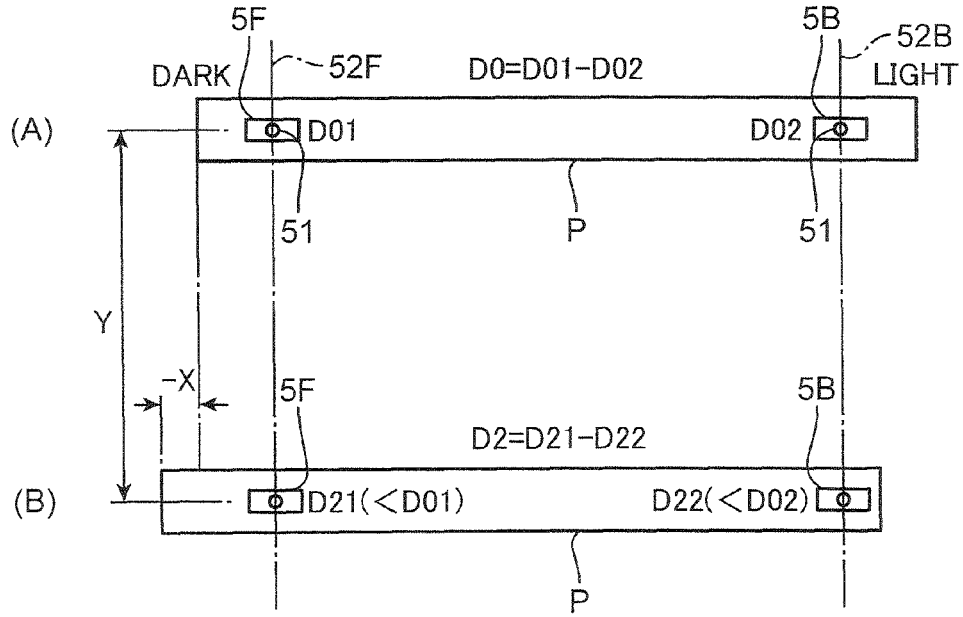
FIG. 9 is a view showing the belt meandering detecting operation.

Contrary to FIG. 8, FIG. 9 shows an example in which the patch toner image P is shifted forward by −X when the intermediate transfer belt 11 moves by the distance Y between the first and second detecting operations. In this case, a second density value D21 detected by the first density sensor 5F in the section (B) of FIG. 9 is a value indicating lower density than a first density value D01 in the section (A) of FIG. 9. This is due to the detection of a lower density area of the patch toner image P by the first density sensor 5F associated with the forward shift of the patch toner image P by −X. The same also applies to the second density sensor 5B. A second density value D22 detected by the second density sensor 5B in the section (B) of FIG. 9 is a value indicating lower density than a first density value D02 in the section (A) of FIG. 9. The shift amount −X can be calculated by comparing the first and second density values D01, D21 obtained by the first density sensor 5F or the first and second density values D02, D22 obtained by the second density sensor 5B. Then, the meandering amount of the intermediate transfer belt 11 can be calculated from the obtained shift amount −X and moving distance Y.

As described above, the meander amount calculator 85 can calculate the meandering amount of the intermediate transfer belt 11 based on a density detection result of either the first density sensor 5F or the second density sensor 5B. However, if an evaluation is made using density values detected by one density sensor as absolute values, an evaluation value of the meandering amount has an error if the density of the patch toner image P changes due to a change of a developing condition or the like. In view of this point, in this embodiment, the meander amount calculator 85 calculates a differential density value between a density value detected by the first density sensor 5F and a density value detected by the second density sensor 5B in each of the first and second detecting operations and this differential density value is treated as the first density value or the second density value. This can eliminate any influence even if the density of the patch toner image P changes.

This point is specifically described based on FIG. 8. The meander amount calculator 85 calculates a differential density value D0=D01−D02 between the first density values D01, D02 detected by the first and second density sensors 5F, 5B in the first detecting operation in the section (A) of FIG. 8 and treats D0 as a first density value. Further, the meander amount calculator 85 calculates a differential density value D1=D11−D12 between the second density values D11, D12 detected by the first and second density sensors 5F, 5B in the second detecting operation in the section (B) of FIG. 8 and treats D1 as a second density value. Then, the meander amount calculator 85 calculates the shift amount +X by comparing the first and second density values D0, D1 and further calculates the moving distance Y to derive a meandering amount W of the intermediate transfer belt 11. Note that if an area on the patch toner image P to be detected by the first density sensor 5F and that on the patch toner image P to be detected by the second density sensor 5B have exactly the same density gradient, the first and second density values D0, D1 can be equal despite the shift of the patch toner image P. The density gradient of the patch toner image P is set so that this trouble does not occur.

The same applies also in the case of the example of FIG. 9. The meander amount calculator 85 calculates a differential density value D0=D01−D02 between the first density values D01, D02 detected by the first and second density sensors 5F, 5B in the first detecting operation in the section (A) of FIG. 9 and treats D0 as a first density value. Further, the meander amount calculator 85 calculates a differential density value D2=D21−D22 between the second density values D21, D22 detected by the first and second density sensors 5F, 5B in the second detecting operation in the section (B) of FIG. 9 and treats D2 as a second density value. Then, the meander amount calculator 85 calculates the shift amount −X by comparing the first and second density values D0, D2 and further calculates the moving distance Y to derive a meandering amount W of the intermediate transfer belt 11.

Referring back to FIG. 6, the table storage 86 stores the meandering correction table T of FIG. 5B described above. The cam controller 87 applies the meandering amount W calculated by the meander amount calculator 85 to the meandering correction table T stored in the table storage 86 to derive a tilt angle A necessary for the meandering correction of the intermediate transfer belt 11. Then, the cam controller 87 drives the cam motor 63 according to the tilt angle A to incline the rotary shaft 14S of the driven roller 14 via the arm 61. For example, if the meandering amount calculated by the meander amount calculator 85 is +W2, the tilt angle necessary for the meandering correction of the intermediate transfer belt 11 is +A2 and the cam controller 87 drives the cam motor 63 by the pulse count number=+2 to incline the rotary shaft 14S according to that tilt angle.

Figure 10A:
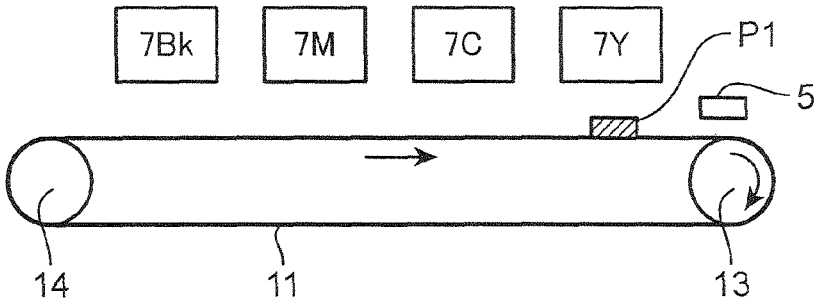
FIGS. 10A to 10C are views showing an example of formation and detection of the toner image for monitoring.
Figure 10B:
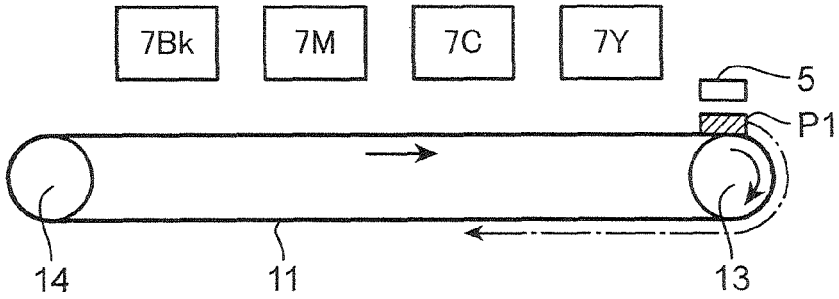
Figure 10C:
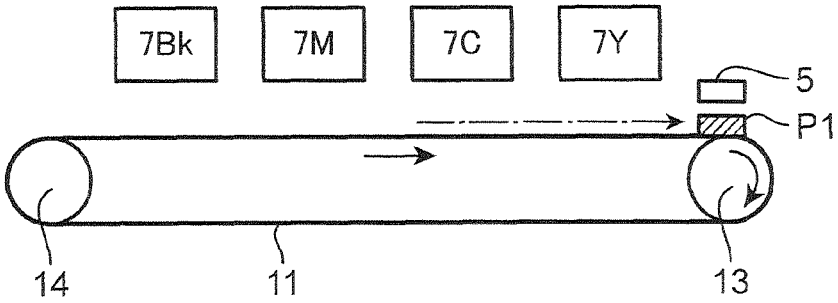

Next, several specific examples of the formation and detection of the patch toner image P are listed. FIGS. 10A to 10C show a first example in which a patch toner image is formed only by one image forming unit and detected in units of the turn of the intermediate transfer belt 11. As shown in FIG. 10A, the patch toner image former 83 causes the yellow unit 7Y (first image forming unit) out of the four image forming units 7Bk, 7M, 7C and 7Y (first and second image forming units) tandemly arranged with respect to the intermediate transfer belt 11 to form a patch toner image P1 (first toner image for monitoring) on the circumferential surface of the intermediate transfer belt 11 in this first example. Of course, the patch toner image P1 may be formed by any unit other than the yellow unit 7Y.

Subsequently, as shown in FIG. 10B, the sensor controller 84 causes the density sensors 5 (first and second density sensors 5F, 5B) to detect the density of the patch toner image P1 as the first detecting operation. Thereafter, the intermediate transfer belt 11 makes one turn by the rotation drive of the intermediate transfer belt 11 by the drive roller 13 and it is waited until the patch toner image P1 reaches the arrangement position of the density sensors 5. Then, when the patch toner image P1 reaches the arrangement position as shown in FIG. 10C, the sensor controller 84 causes the density sensors 5 to detect the patch toner image P1 again as the second detecting operation. Of course, the second detecting operation may be performed after the intermediate transfer belt 11 makes two or more turns.

According to this first example, the patch toner image P1 transferred by one of the plurality of tandemly arranged image forming units is detected by the density sensors 5 at least in each turn of the intermediate transfer belt 11. Thus, the meandering amount in one turn of the intermediate transfer belt 11 can be appropriately detected. Further, since the moving distance Y becomes longer as the number of the turns increases, the meandering amount of the intermediate transfer belt 11 can be more accurately calculated.

Figure 11A:
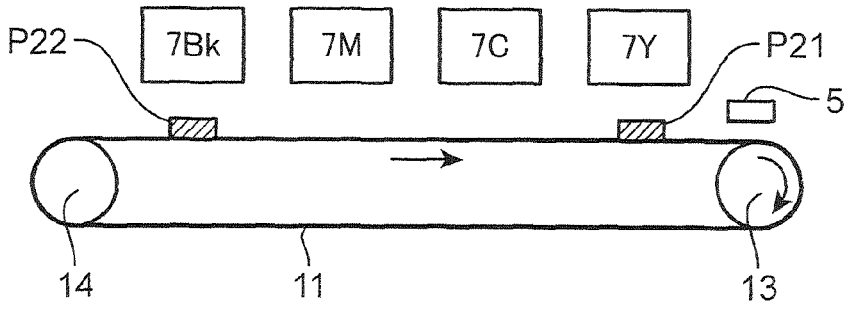
FIGS. 11A to 11C are views showing another example of formation and detection of the toner image for monitoring.
Figure 11B:
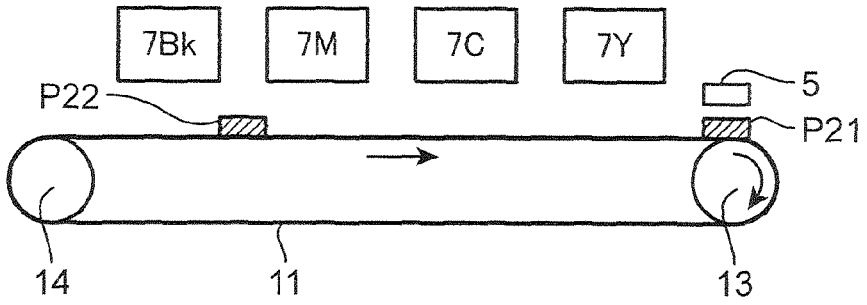
Figure 11C:
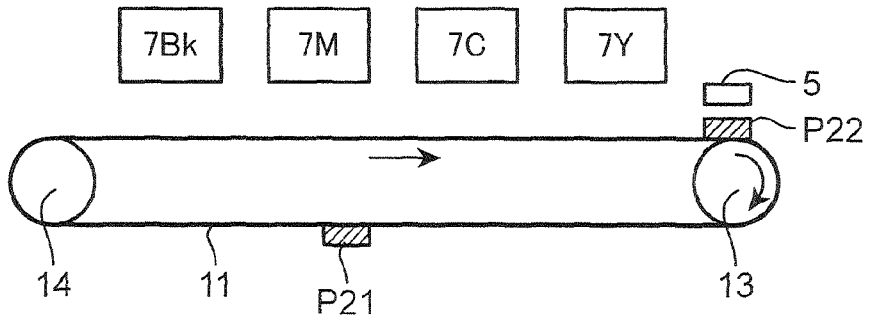

FIGS. 11A to 11C show a second example in which patch toner images are formed by two image forming units and detected within one turn of the intermediate transfer belt 11. As shown in FIG. 11A, the patch toner image former 83 causes the yellow unit 7Y (first image forming unit) and the black unit 7Bk out of the four image forming units 7Bk, 7M, 7C and 7Y tandemly arranged with respect to the intermediate transfer belt 11 to form a first patch toner image P21 (first toner image for monitoring) and a second patch toner image P22 (second toner image for monitoring) on the circumferential surface of the intermediate transfer belt 11 in this second example. As shown, the yellow unit 7Y and the black unit 7Bk are units most distant from each other in the belt rotating direction out of the tandemly arranged four image forming units.

Subsequently, as shown in FIG. 11B, the sensor controller 84 causes the density sensors 5 to detect the density of the first patch toner image P21 as the first detecting operation. Thereafter, the circumferential surface of the intermediate transfer belt 11 is moved by the rotational drive of the intermediate transfer belt 11 by the drive roller 13 and it is waited until the second patch toner image P22 reaches the arrangement position of the density sensors 5. Then, when the second patch toner image P22 reaches the arrangement position as shown in FIG. 11C, the sensor controller 84 causes the density sensors 5 to detect the second patch toner image P22 as the second detecting operation. Of course, the second detecting operation may be performed after the intermediate transfer belt 11 makes more than one turn.

According to this second example, the meandering amount can be detected not in each turn of the belt, but at any arbitrary moving distance by causing the density sensors 5 to successively detect the first and second patch toner images P21, P22 transferred to the circumferential surface of the intermediate transfer belt 11 by two different image forming units. Particularly, if the first and second detecting operations are performed within one turn of the intermediate transfer belt 11, the meandering amount can be detected within one turn of this belt. Thus, a time required for the belt meandering correcting operation can be shortened.

Further, even in such detection within one turn, the moving distance Y can be longest if the yellow unit 7Y located at one end and the black unit 7Bk located at the other end are selected as patch toner image forming units out of the tandemly arranged four image forming units as shown in FIGS. 11A to 11C. Thus, the meandering amount of the intermediate transfer belt 11 can be more accurately detected.

Figure 12A:
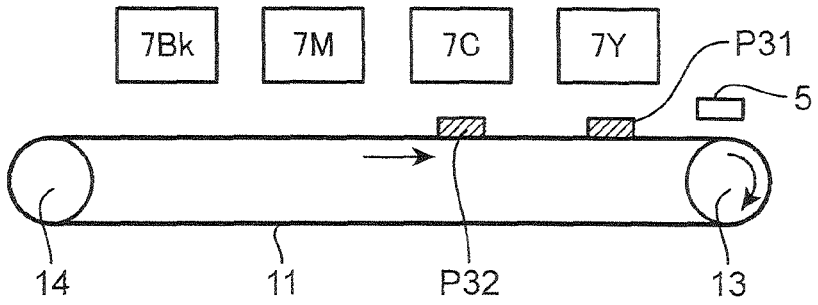
FIGS. 12A to 12C are views showing still another example of formation and detection of the toner image for monitoring.
Figure 12B:
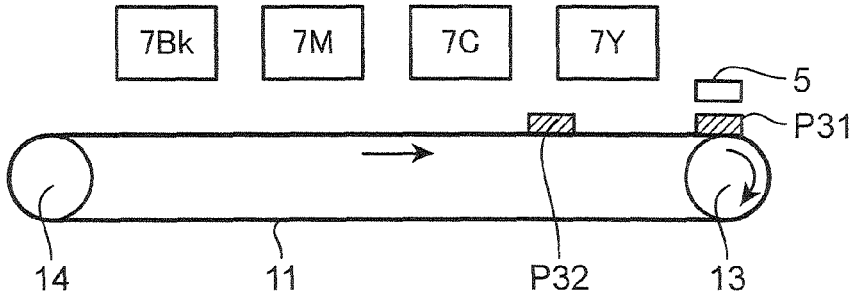
Figure 12C:
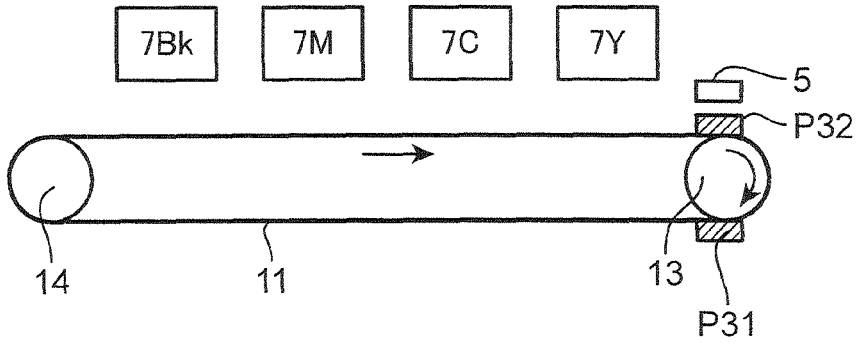

FIGS. 12A to 12C show a third example in which patch toner images are formed by two image forming units and detected within one turn of the intermediate transfer belt 11. As shown in FIG. 12A, the patch toner image former 83 causes the yellow unit 7Y (first image forming unit) and the adjacent cyan unit 7C to form a first patch toner image P31 (first toner image for monitoring) and a second patch toner image P32 (second toner image for monitoring) on the circumferential surface of the intermediate transfer belt 11 in this third example. Of course, a combination of the other units may be adopted if the units are adjacent to each other.

Subsequently, as shown in FIG. 12B, the sensor controller 84 causes the density sensors 5 to detect the density of the first patch toner image P31 as the first detecting operation. Thereafter, the circumferential surface of the intermediate transfer belt 11 is moved by the rotational drive of the intermediate transfer belt 11 by the drive roller 13 and it is waited until the second patch toner image P32 reaches the arrangement position of the density sensors 5. Then, when the second patch toner image P32 reaches the arrangement position as shown in FIG. 12C, the sensor controller 84 causes the density sensors 5 to detect the second patch toner image P32 as the second detecting operation.

According to this third example, a time required between the first and second detecting operations can be shortest since the yellow unit 7Y and the cyan unit 7C arranged adjacent to each other are selected as patch toner image units. Thus, the meandering amount of the intermediate transfer belt 11 can be calculated in a shortest time.

Figure 13:
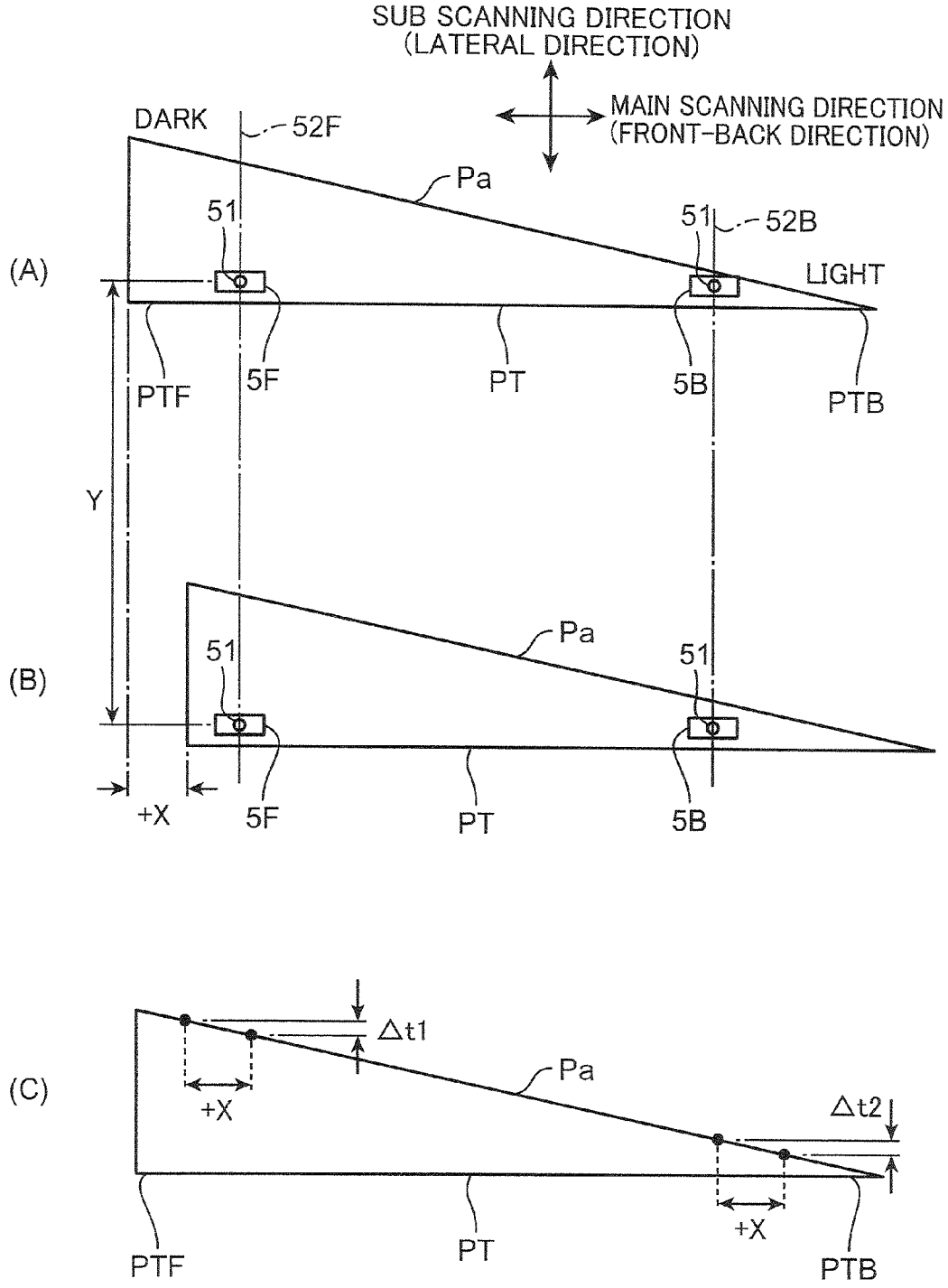
FIG. 13 is a view showing another formation example of the toner image for monitoring.

Next, another formation example of the patch toner image is described based on FIG. 13. FIG. 13 illustrates a patch toner image PT having a right triangular shape in a top view other than a strip-like shape of the aforementioned patch toner image. With reference to a section (A) of FIG. 13, the width of the patch toner image PT gradually changes in a sub scanning direction perpendicular to the main scanning direction (belt width direction/front-back direction of FIG. 7), a side thereof on a front side in the rotating direction of the intermediate transfer belt 11 is a hypotenuse Pa and a side on a rear side is a straight side extending in the main scanning direction. A front end part PTF of the patch toner image PT has a longest width in the sub scanning direction and a rear end part PTB has a shortest width in the sub scanning direction. Further, a density pattern of the patch toner image PT is such that density gradually changes so that the density of the front end part PTF is highest and that of the rear end part FTB is lowest similarly to the example of FIG. 7. Such a patch toner image is formed by the patch toner image former 83.

Under the control of the sensor controller 84, the first density sensor 5F detects density along a detection line 52F at a position near the front end part PTF of the patch toner image PT and the second density sensor 5B detects density along a detection line 52B at a position near the rear end part PTB. Sections (A) and (B) of FIG. 13 show a positional relationship between the patch toner image PT and the first and second density sensors 5F, 5B in a state where a first detecting operation and a second detecting operation are being performed and an example in which the patch toner image PT is shifted backward by +X when the intermediate transfer belt 11 moves by a distance Y between the first and second detecting operations.

In this case, both of the first and second density sensors 5F, 5B come to detect higher density as the patch toner image PT is shifted backward by +X. This is the same as the example shown in FIG. 8. In addition, by forming this patch toner image PT, the shift of the patch toner image PT, i.e. the meandering of the intermediate transfer belt 11 can be detected by a passage time of the patch toner image PT through the detection area 51 of each of the first and second density sensors 5F, 5B.

As shown in the sections (A) and (B) of FIG. 13, passing positions of the detection lines 52F, 52B on the patch toner image PT are also shifted by +X in the main scanning direction by the shift of the patch toner image PT by the shift amount +X. Then, times during which the first and second density sensors 5F, 5B detect the presence of the patch toner image PT change in the first and second detecting operations since the width of the patch toner image PT in the sub scanning direction changes. More specifically, as shown in a section (C) of FIG. 13, passing positions of the detection lines 52F, 52B on the hypotenuse Pa are shifted, whereby a time at which the first density sensor 5F starts detecting the patch toner image PT is changed by Δt1 and a time at which the second density sensor 5B starts detecting the patch toner image PT is changed by Δt2 (in this example, advanced by Δt1, Δt2). Thus, the meandering of the intermediate transfer belt 11 can be detected based on time differences Δt1, Δt2.

In the case of using such a patch toner image PT, a table relating the width of the patch toner image PT in the sub scanning direction and a detection time thereof is stored in the table storage 86 in advance. The meandering amount calculator 85 calculates the meandering amount of the intermediate transfer belt 11 by referring to this table and passage times of the patch toner image PT actually detected in the first and second detecting operations by the first and second density sensors 5F, 5B. Then, the meandering amount calculator 85 increases the reliability of a meandering amount calculated value such as by calculating an average value of a meandering amount calculated from these passage times and a meandering amount calculated based on a density change. According to this embodiment, the meandering amount of the intermediate transfer belt 11 can be more accurately detected using not only density information of the patch toner image PT, but also temporal information, i.e. detection timings (detection times) of the patch toner image PT.

As described above, according to the present disclosure, the meandering amount of the intermediate transfer belt 11 can be calculated effectively using the density sensors 5 (5F, 5B) generally provided for the density calibration of toner images to be carried on the circumferential surface of the intermediate transfer belt 11 in the image forming apparatus 1 including the endless belt (intermediate transfer belt 11). Specifically, the meandering of the intermediate transfer belt 11 can be corrected without using a dedicated displacement sensor for detecting the meandering of the intermediate transfer belt 11. Thus, there is an advantage of eliminating the need for installation cost of a displacement sensor exclusively used to detect the meandering of the intermediate transfer belt 11 and an installation space.

Although one embodiment of the present disclosure has been described in detail above, the present disclosure is not limited to this. The present disclosure can be, for example, modified as follows.

(1) The example in which the patch toner image having a density gradient in the main scanning direction is transferred to the intermediate transfer belt 11 is shown in the above embodiment. Instead of this, a patch toner image having constant density and a varying width in the sub scanning direction as shown in FIG. 13 may be used. In this case, the meandering amount may be calculated based only on the passage times of the patch toner image.

(2) The example in which the strip-like patch toner image is formed is shown in the above embodiment. Instead of this, point-like or rectangular small patch toner images may be transferred to correspond to the detection areas of the density sensors 5. In this case, the meandering amount may be calculated based on how many turns can be made by the belt while a state where the small patch toner images are detectable can be continued.

(3) The example in which the first and second density sensors 5F, 5B are arranged (utilized) is shown in the above embodiment. Instead of this, either one of the first and second density sensors 5F, 5B may be used and a patch toner image may be transferred to correspond to that density sensor.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an endless belt that has a circumferential surface, to which a toner image is to be transferred, and is driven and rotated, the belt having opposite first and second end sides that are spaced apart in a belt width direction that is perpendicular to a direction in which the belt is driven and rotated;

an image forming unit that is arranged to face the belt and forms the toner image and transfers the toner image to the belt;

a plurality of rollers that include a drive roller for driving and rotating the belt and a belt meandering correction roller for correcting meandering in the belt width direction and on which the belt is mounted;

a roller position adjusting mechanism that corrects the meandering of the belt by adjusting a position of the belt meandering correction roller;

first and second density sensors arranged respectively in proximity to the first and second end sides of the belt, each of the first and second density sensors having a detection area capable of detecting the density of the toner image and each being fixedly arranged such that the detection area faces the circumferential surface of the belt; and a control unit that controls a correcting operation of correcting the meandering of the belt by the roller position adjusting mechanism;

wherein, prior to the correcting operation, the control unit:

controls the image forming unit while driving and rotating the belt, thereby transferring a toner image for monitoring at least to an area of the circumferential surface of the belt passing the detection areas of the first and second density sensors, the toner image for monitoring extending continuously between the first and second end sides of the belt along a main scanning direction and having a density pattern in which density gradually changes so that the density at the first end side of the belt is highest and the density at the second end side of the belt is lowest;

causes the first and second density sensors to perform a first detecting operation of detecting the toner image for monitoring;

causes the first and second density sensors to perform a second detecting operation of detecting the toner image for monitoring after the belt is driven and rotated to move the circumferential surface by a predetermined distance after the first detecting operation; and calculates a meandering amount of the belt by comparing a first density value obtained by the first detecting operation and a second density value obtained by the second detecting operation, wherein the control unit treats a differential density value between a density value detected by the first density sensor and a density value detected by the second density sensor as the first or second density value.

2. An image forming apparatus according to claim 1, wherein:

the image forming unit includes a first image forming unit and a second image forming unit tandemly arranged with respect to the belt; and the control unit:

causes the first image forming unit to transfer a first toner image for monitoring to the circumferential surface of the belt;

causes the first toner image for monitoring to be detected as the first detecting operation; and causes the first toner image for monitoring to be detected again as the second detecting operation after the belt is rotated at least one turn.

3. An image forming apparatus according to claim 1, wherein:

the image forming unit includes a first image forming unit and a second image forming unit tandemly arranged with respect to the belt; and the control unit:

causes the first image forming unit to transfer a first toner image for monitoring to the circumferential surface of the belt and causes the second image forming unit to transfer a second toner image for monitoring to the circumferential surface of the belt;

causes the first toner image for monitoring to be detected as the first detecting operation; and causes the second toner image for monitoring to be detected as the second detecting operation after the belt is moved by a predetermined distance.

4. An image forming apparatus according to claim 3, wherein:

the control unit performs the first and second detecting operations within one turn of the belt.

5. An image forming apparatus according to claim 4, wherein:

the image forming unit includes four image forming units tandemly arranged with respect to the belt and configured to form toner images of mutually different colors; and the first image forming unit is the image forming unit arranged at one end out of the tandemly arranged four image forming units and the second image forming unit is the image forming unit arranged on the other end.

6. An image forming apparatus according to claim 1, wherein:

the image forming unit forms the toner image for monitoring so that a width of the toner image for monitoring in a sub scanning direction perpendicular to the main scanning direction gradually changes; and the control unit calculates the meandering amount of the belt by further referring to timings of the first detecting operation and the second detecting operation by the first and second density sensors.

7. A method for calculating a meandering amount of an endless belt which has a circumferential surface, to which a toner image is to be transferred, and is driven and rotated, comprising:

fixedly arranging a first density sensor at a first end side of the belt in a belt width direction and a second density sensor at a second end side of the belt in the belt width direction, each of the density sensors having a detection area capable of detecting a density of a toner image such that the detection area faces the circumferential surface of the belt;

forming a toner image for monitoring in an area of the circumferential surface of the belt passing the detection areas of the first and second density sensors, the toner image for monitoring extending continuously from the first end side to the second end side along a main scanning direction and having a density pattern in which density gradually changes so that the density at the first end side of the belt is highest and the density at the second end side is lowest;

detecting the toner image for monitoring as a first detecting operation by the first and second density sensors;

detecting the toner image for monitoring as a second detecting operation by the first and second density sensors after the circumferential surface is moved by a predetermined distance by driving and rotating the belt after the first detecting operation;

calculating the meandering amount in a belt width direction perpendicular to a rotating direction of the belt by comparing a first density value obtained by the first detecting operation and a second density value obtained by the second detecting operation; and treating a differential density value between a density value detected by the first density sensor and a density value detected by the second density sensor as the first or second density value.

8. A method according to claim 7, wherein:

a toner image having the density pattern in which density gradually changes and having a width gradually changing in a sub scanning direction perpendicular to the main scanning direction is formed as the toner image for monitoring.

* * * * *